United States Patent [19]

Argento

[11] Patent Number: 4,834,576

[45] Date of Patent: May 30, 1989

[54] EXPANSION JOINT AND FORM FOR CONCRETE FLOORS

[76] Inventor: Settimio Argento, 7900 Marco Polo Street, Montreal, Canada, H1E 2S5

[21] Appl. No.: 137,725

[22] Filed: Dec. 24, 1987

[51] Int. Cl.[4] ..... E01L 11/14

[52] U.S. Cl. ..... 404/62; 404/69

[58] Field of Search ..... 404/47–52, 404/56, 59–63, 67–69; 14/61.1, 16.5; 52/395, 396, 403, 573

[56] References Cited

U.S. PATENT DOCUMENTS

| | | | |
|---|---|---|---|
| 152,183 | 2/1910 | Moody | 292/150 |
| 1,241,826 | 10/1917 | Davis | 404/47 |
| 1,768,838 | 7/1930 | Heltzel | 404/48 |
| 1,880,725 | 10/1932 | Bleck | 404/48 |
| 1,947,401 | 2/1934 | Birdsey et al. | 52/435 |
| 2,019,131 | 10/1935 | Hall et al. | 404/69 X |
| 2,040,367 | 5/1936 | Eichelman et al. | 404/69 X |
| 2,062,654 | 12/1936 | Jacobson et al. | 404/63 X |
| 2,079,123 | 5/1937 | Lind | 404/62 |
| 2,096,254 | 10/1937 | McCrady, Jr. | 404/62 |
| 2,171,709 | 9/1939 | Niel, Jr. | 404/48 |
| 2,179,911 | 11/1939 | Wilmoth | 404/61 |
| 2,321,087 | 6/1943 | Jacobson | 404/63 |
| 2,365,550 | 12/1944 | Heltzel | 404/62 X |
| 2,467,806 | 4/1949 | Brickman | 404/63 |
| 2,627,793 | 2/1953 | White | 404/62 |
| 2,642,789 | 6/1953 | Brickman | 404/62 |
| 2,829,572 | 4/1958 | Vanek | 404/62 |
| 2,834,266 | 5/1958 | Brickman | 404/63 |
| 3,395,507 | 8/1968 | Moody | 404/55 X |
| 3,572,225 | 3/1971 | Burton | 404/47 |
| 4,012,024 | 3/1977 | Courtois | 404/48 X |
| 4,507,902 | 4/1985 | Lucas | 404/48 X |
| 4,522,531 | 6/1985 | Thomson et al. | 404/62 X |
| 4,576,510 | 3/1986 | Ljungkvist et al. | 404/68 X |

FOREIGN PATENT DOCUMENTS

| | | | |
|---|---|---|---|
| 562018 | 10/1932 | Fed. Rep. of Germany | 404/68 |

*Primary Examiner*—Stephen J. Novosad
*Assistant Examiner*—John F. Letchford

[57] ABSTRACT

An expansion joint and form for concrete floors, consisting of a free-standing assembly comprising a vertical asphaltic board, a metallic panel flatly abutting against the asphaltic board, and a number of load transfer dowels or rods slidingly passing horizontally through the board and panels to extend on each slide of the panel and board. The rod partially engages at one end a sleeve and one rod section is covered with grease. After fresh concrete is successively poured on each side of the expansion joint, the concrete will harden unto the board, the panel and the sleeve exclusively of the rod section covered with grease. Hence, the rod will be movable relative to the sleeve and surrounding concrete slab, allowing for relative horizontal displacement of the pair of proximate concrete slabs.

6 Claims, 2 Drawing Sheets

EXPANSION JOINT AND FORM FOR CONCRETE FLOORS

FIELD OF THE INVENTION

This invention relates to expansion joints for concrete floors.

BACKGROUND OF THE INVENTION

It is known to use epxansion joints within concrete floorings, to take into account thermal expansionretraction of the concrete. Indeed, there must be provided means whereby some level of horizontal relative play of adjacent concrete slabs be possible, otherwise the flooring will crack and its integrity will become at stake.

Typical prior art includes U.S. Pats. Nos. 2,171,709 issued in 1939; 3,395,507 issued in 1968; and 3,572,225 issued in early 1971. All these (expired) patents show some form of panel assembly vertically mounted between a proximate pair of concrete blocks or slabs. The panel assembly defines a compressible section whose thickness may vary in accordance with relative horizontal displacements of the slabs. These expansion joints further include a large dowel extending horizontally, so as to prevent relative vertical displacement of the slabs with respect to one another.

In the first above-mentioned patent, issued to Niel, Jr, there is shown in FIG. 3 one concrete slab being anchored to the sub-floor G by vertical anchor stakes 15, 20, while the other concrete slab is engaged by the horizontal dowel 14 which project from said one concrete slab.

One drawback of Niel, Jr's expansion joint is that the concrete will harden unto the whole of the horizontal dowel 14 (which extends through both concrete slabs), and, since the dowel is therefore integral to the two concrete slabs, further compression of the compression board sandwiched between the two slabs is impossible while displacement of the slabs away from each other will be very difficult.

OBJECT OF THE INVENTION

Therefore, the main object of the present invention is to provide an expansion joint for concrete floors, characterized by its increased efficiency and low manufacturing cost.

In accordance with the objects of the invention, there is disclosed an expansion joint and form for a horizontal concrete base supported by a rock bed ground, comprising: a rigid rectangular main panel having a longitudinally edgewisely transverse integral bottom flange abutting against the ground for supporting said panel in upright position; a rectangular compression board, longitudinally edgewisely ground supported and flatly abutting against the face of said panel opposite said bottom flange and made from a compressible partially resilient material; a few dowel rods, each transversely horizontally extending through registering bores in said panel and board spacedly over said bottom flange and partially slidably engaging at one end thereof a sleeve member which is closed at its outer end, said rods projecting from both sides of said compression board and main panel; an upper flange, transversely extending from and fixedly secured to an upper section of said main panel parallel to and in vertical register with said bottom flange; a few small centrally bored rigid hook plates, transversely downwardly extending from and fixedly connected to an outer section of said upper flange parallel to said main panel, each small bored plate being in horizontal register with one pair of said registering bores of said main panel and compression board and transversely supportingly engaged by a corresponding said dowel rod; and a few anchor stakes, each transversely extending through said top and bottom flanges in vertically registering bores between said main panel and the level of said hook plates at regular lengthwise intervals thereof and anchoringly driven into said rock bed; wherein fresh concrete is poured first over the dowel rods sections projecting beyond said compression board, and after complete curing of this concrete, fresh concrete is poured thereafter over the opposite dowels rods sections, whereby two opposite concrete slabs horizontally spaced by said expansion joint are thus obtained.

Preferably, the height of said compression board is greater than that of said main panel, and further including a sealing strip applied against the top edge of said compression board and of such a weight as to come in register with the top edge of said concrete slabs.

Advantageously, the dowel rods sections projecting beyond said main panel are coated with a grease compound.

It is desirably that at least two such expansion joints be provided, being endwisely orthogonally mounted to each other, and further including a large metallic grid, edgewisely supported in horizontal position by said upper flanges of the two said expansion joints, the fresh concrete being poured over said grid. Alternately or concurrently, such joints could be endwisely coaxially mounted to each other, wherein each of said top and bottom flanges of each expansion joint defines a first lengthwise "female" end extending short of the corresponding end edge of said main panel and an opposite second "male" end projecting beyond the corresponding end edge of said main panel; wherein said male and female ends constitute interdigitating connecting means.

Preferably, there are a number of such expansion joints, being arranged in rows and columns and in combination with a corresponding number of concrete slabs.

DETAILED DESCRIPTION OF THE INVENTION

Figure 1:
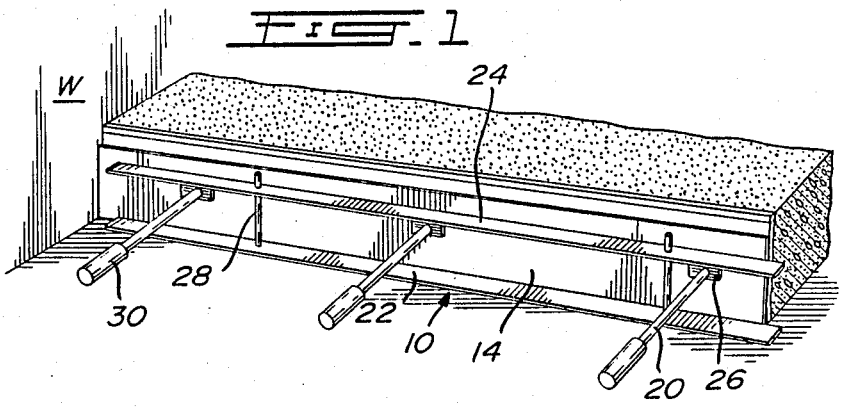
FIG. 1 is a perspective view of a combined concrete form and expansion joint for a concrete floor in accordance with the teachings of the invention.

The expansion joint of the invention is denoted 10 and consists of an elongated rectangular asphaltic board 12 against which is fixedly applied an elongated metallic panel 14, of a dimension similar to that of board 12 but defining a top edge 14A extending short of the corresponding top edge 12A of board 12. Board 12 should be made of a material which is compressible and at least partially resilient. Board 12 includes a few bores 16 and panel 14 includes also a few bores 18 adapted to come in register with bores 16. An elongated dowel rod 20 is in slidable engagement through each pair of bores 16–18.

Figure 4:
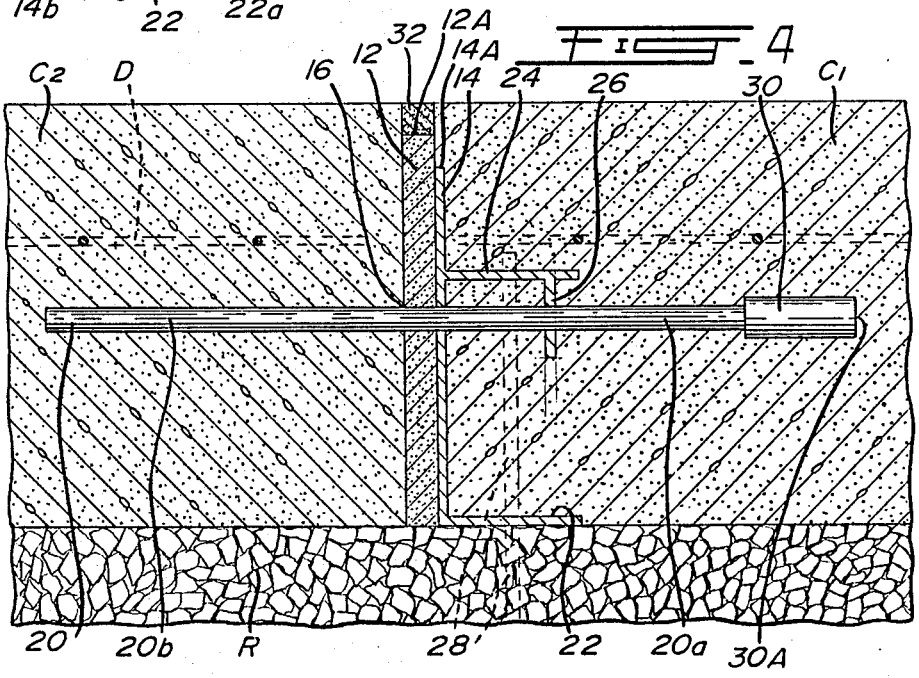
FIG. 4 is a partly broken vertical sectional view of said flooring and embedded expansion joint thereof.
Figure 2:
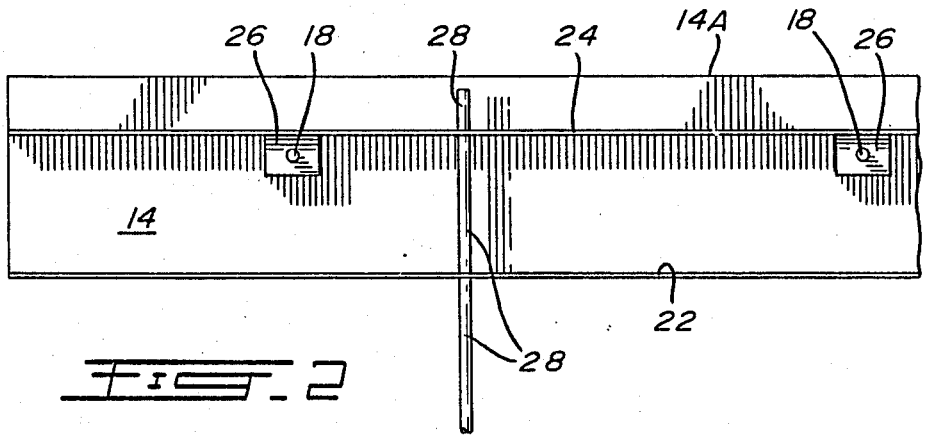
FIG. 2 is a front elevational view of the form and expansion joint.

The bottom end of the metal panel 14 includes an integral flange 22, being orthogonal to panel 14. Flange 22 is in register with the bottom edge of asphaltic board 12, so as to flatly abut against the horizontal top surface of a rocky bed R at the base of the undertaking. Moreover, panel 14 includes a intermediate outturned flange 24, similar to flange 22. Flange 24 is slightly above the level of bores 18 and includes at its free end a few downwardly dependent hooks 26, each in register with a given bore 18 so as to be slidably engaged by a corresponding rod 20. Hence, hooks 26 and bores 16–18 support each rod 20 in horizontal position, with the intermediate section of these rods 20 being at the level of bores 16–18. Flange 22 is further connected to flange 24 by a few anchor stakes 28 driven into the rock bed R, as suggested in FIGS. 2 and 4, to maintain the flanges 22 and 24 parallel to the ground or rock bed R, so that the panel 14 serves as a concrete form during pouring and curing of a concrete slab within the confines of a four sided cavity defined by said forms or by said forms and a wall W.

Figure 1A:
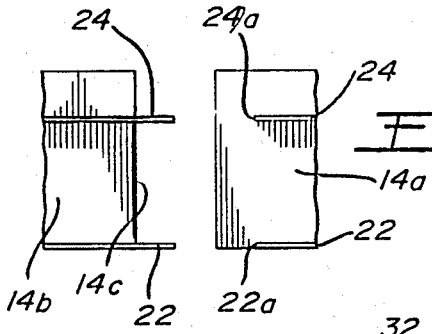
FIG. 1*a* is a front elevation of the two mating ends of two adjacent panels.

As illustrated in FIGS. 1–1*a*, each panel 14 has a female end 14*a* with cut out end portions 22*a*, 24*a* of flanges 22 and 24, and a male end 14*b* with a cut out end portion 14*c* of panel end 14*b*. Therefore, adjacent panels 14 can be interdigitated and maintained in alignment to provide a straight form and joint.

In accordance with the heart of the invention, the outer end of rod 20 is at least partially engaged into a sleeve member 30 being closed at its outer end 30A, wherein a displacement gap is defined within the sleeve 30; and the section rod 20*a* which extends from panel 14 to sleeve 30 is covered with grease G, for a purpose outlined hereinbelow.

Figure 3:
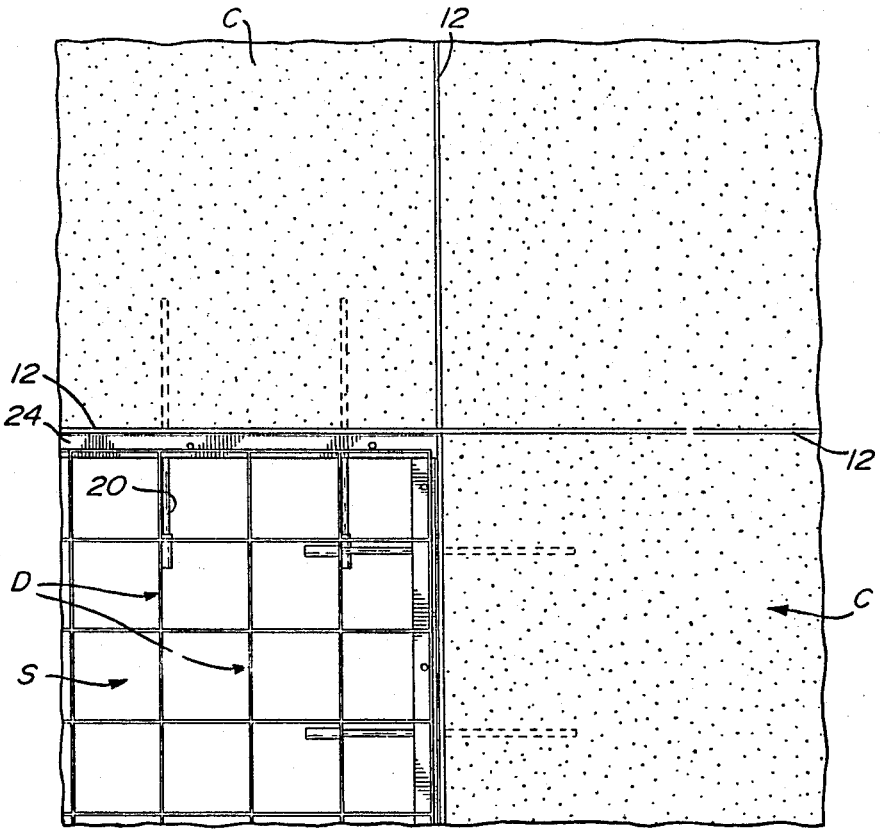
FIG. 3 is a top plan view of the expansion joint embedded into a partly finished concrete flooring.

In operation, a number of panels 14 and asphaltic boards 12 are conventionally laid on the rocky bed R in orthogonal relation, wherein square or rectangular cavities S are defined. Wall W forms the fourth side of adjacent cavities. Rods 20 and sleeves 30 are then positioned. Fresh concrete is then successively poured into each cavity S and left to cure to form concrete slabs C. Prior to concrete pouring, a metallic reinforcing grid D of conventional make is preferably installed in cavity S, see FIG. 3.

It is understood that, because of the grease pellicule surrounding rod section 20*a* (FIG. 4), concrete will not adhere to the latter. This means that rod 20 will be able to be lengthwisely "displaceable" relative to slab C, and into sleeve 30, which sleeve will of course be fixedly embedded into slab C1. Since rod section 20*b* is preferably not coated with grease, slab C2 will adhere to the same. Since rods 20 are free to move longitudinally of slab C1, temperature variations affecting the flooring will allow the expansion joints to be fully effective.

The gap 12*a* above the asphaltic board 12 is conventionally filled with a sealing strip 32.

What I claim is:

1. An expansion joint and form for a horizontal concrete base supported by a rock bed ground, comprising: a rigid rectangular main panel having a longitudinally edgewisely transverse integral bottom flange abutting against the ground for supporting said panel in upright position; a rectangular compression board, longitudinally edgewisely ground supported and flatly abutting against the face of said panel opposite said bottom flange and made from a compressible partially resilient material; a few dowel rods, each transversely horizontally extending through a pair of registering bores in said panel and board spacedly over said bottom flange and partially slidably engaging at one end thereof a sleeve member which is closed at its outer end, said rods projecting from both sides of said compression board and main panel; an upper flange, transversely extending from and fixedly secured to an upper section of said main panel parallel to and in vertical register with said bottom flange; a few small centrally bored rigid hook plates, transversely downwardly extending from and fixedly connected to an outer section of said upper flange parallel to said main panel, each small bored plate being in horizontal register with said pair of said registering bores of said main panel and compression board and transversely supportingly engaged by a corresponding said dowel rod; and anchor stakes, each transversely extending at regular lengthwise intervals through said upper and bottom flanges parallel to said main panel and anchoringly driven into said rock bed; wherein fresh concrete is poured first over the dowel rods sections projecting beyond said compression board at the panel side opposite to said bottom flange, and after complete curing of this concrete, fresh concrete is poured thereafter over the opposite dowels rods sections, whereby two opposite concrete slabs horizontally spaced by said expansion joint are thus obtained.

2. An expansion joint as defined in claim 1, wherein the height of said compression board is greater than that of said main panel, and further including a sealing strip applied against the top edge of said compression board and of such a weight as to come in register with the top edge of said concrete slabs.

3. An expansion joint as defined in claim 1, wherein the dowel rods sections projecting beyond said main panel on said upper and bottom flanges side of said main panel are coated with a grease compound.

4. At least two expansion joints as the one defined in claim 1, being endwisely orthogonally mounted to each other, and further including a large metallic grid, edgewisely supported in horizontal position by said upper flanges of the two said expansion joints, the fresh concrete being poured over said grid.

5. At least two expansion joints as the one defined in claim 1, being edgewisely coaxially mounted to each other, wherein each of said upper and bottom flanges of each expansion joint defines a first lengthwise "female" end extending short of a corresponding first end edge of said main panel and an opposite second "male" end projecting beyond a corresponding second end edge of said main panel; wherein said male and female ends constitute interdigitating connecting means.

6. A number of expansion joints as the one defined in claim 1, being arranged in rows and columns and in combination with a corresponding number of concrete slabs.

* * * * *